US008888535B2

(12) United States Patent
Knight et al.

(10) Patent No.: US 8,888,535 B2
(45) Date of Patent: Nov. 18, 2014

(54) CORROSION RESISTANT ELECTRICAL ASSEMBLY WITH CONNECTORS AND MULTI-PORT JUNCTION BLOCK

(75) Inventors: Steven James Knight, Mission Hill, SD (US); Jason E. Anderson, Yankton, SD (US)

(73) Assignee: Shur-Co, LLC, Yankton, SD (US)

( * ) Notice: Subject to any disclaimer, the term of this patent is extended or adjusted under 35 U.S.C. 154(b) by 0 days.

(21) Appl. No.: 13/608,934

(22) Filed: Sep. 10, 2012

(65) Prior Publication Data

US 2014/0073180 A1 Mar. 13, 2014

(51) Int. Cl.

*H01R 25/00* (2006.01)
*H01R 13/52* (2006.01)
*H01R 13/639* (2006.01)

(52) U.S. Cl.

CPC ..... *H01R 13/5221* (2013.01); *H01R 13/6392* (2013.01); *H01R 2201/26* (2013.01)
USPC ..... 439/650

(58) Field of Classification Search

USPC ..... 439/650–654, 588, 76.2, 272, 273, 281, 439/282, 347, 723, 724, 949, 503–505, 511, 439/211, 212, 214; 174/48–50, 56, 520, 174/541, 480, 481, 72 A, 72 R, 563; 361/679.01, 752, 823
See application file for complete search history.

(56) References Cited

U.S. PATENT DOCUMENTS 4,659,161 A * 4/1987 Holcomb ..... 439/490
4,775,802 A * 10/1988 Dods ..... 307/147
5,368,499 A * 11/1994 Hirt ..... 439/350
5,857,875 A * 1/1999 Hsu et al. ..... 439/652
5,995,380 A 11/1999 Maue et al.
6,939,178 B2 * 9/2005 Arcykiewicz et al. ..... 439/638
7,613,003 B2 * 11/2009 Pavlovic et al. ..... 361/709

OTHER PUBLICATIONS

Switchcraft EN3 Mini Harsh Environment Overmolds, http://www.switchcraft.com/Documents/NPB_578-_EN3_overmolds_4page_031209.pdf.
LMG-FS and Associated Parts, Standard Rubber Molded, In-Line Series, http://seaconworldwide.com/wp-content/uploads/2011/07/RM_LMG-FS_and_Associated_Parts.pdf.
SB175 Connectors—up to 280 Amps, http://www.andersonpower.com/litlib/files.html/download/156.
Phillips Permacoil, http://www.phillipsind.com/product/5.html.
7-Pole Junction Box Trailer Cordset [10110-048BX], http://cordtec.com/products.asp?id=237.
3-Outlet Wall Tap,http://www.sterenusa.com/3-outlet-wall-tap.

* cited by examiner

*Primary Examiner* — R S Luebke
*Assistant Examiner* — Harshad Patel
(74) *Attorney, Agent, or Firm* — Jeffrey A. Proehl; Woods, Fuller, Shult & Smith, P.C.

(57) ABSTRACT

A corrosion resistant electrical system for communicating between a power source and multiple electric devices on a truck box or trailer. A hard plastic junction block with a male connector for power input communicates internally with two or more female connectors for power output, allowing multiple electric motors or other devices to receive electricity from a single power cable. The assembly includes cables with female or male connectors at the ends, the connectors having corresponding projecting portions and passageways, and U-shaped flanges and spaces, that fit together. The space between the projecting portions and the passageways are sealed by a resilient gasket around the projecting portion, and the U-shaped flanges and projecting portions contain aligned apertures to receive a lock pin to secure the mated connectors together.

27 Claims, 8 Drawing Sheets

CORROSION RESISTANT ELECTRICAL ASSEMBLY WITH CONNECTORS AND MULTI-PORT JUNCTION BLOCK

FIELD OF THE INVENTION

The field of the invention relates to electrical connectors and junction blocks, and more particularly to a system of sealed, corrosion resistant and securely mated electrical cables, connectors and junction blocks.

BACKGROUND OF THE INVENTION

In recent years the number of electric motors and electric devices associated with truck boxes and trailers has increased. All of the motors and other electric devices on a truck box or trailer typically require DC current from a single battery located on the truck cab. Electric cables need to connect each of the motors and devices to the battery or other power source. Making multiple battery-to-motor connections individually requires the use of multiple, lengthy and expensive cables that tend to clog the wiring channels, if multiple cables can even fit in those channels.

In order to reduce the expense and burden of using multiple, lengthy cables between the battery and the electric motors or other devices, junction boxes have been employed. Such boxes used a single cable to create a power source at a more convenient location on the truck box or trailer devices in need of electricity. This reduced the expense of and channel clogging caused by multiple cables traversing the same path, but created other problems.

For example, connecting cables to the junction box is laborious as heavy cables need to be cut to length, stripped of insulation on each conductor and attached to terminals on the box. At the end of the cable attached to an electric motor or device, each conductor needed to be stripped and crimped or soldered onto heavy duty ring terminals. These operations require special tools and extra installation labor, and can be time consuming and expensive to perform.

Electric motors and devices are often added to a truck box or trailer after it is manufactured and delivered, i.e., as a retrofit product or accessory. This increases the difficulty of wiring as the original arrangement may not accommodate the addition of more cables and connections to the junction box. Moreover, retrofit additions of motors or other devices requires that modifications be made by persons (such as equipment operators) in the field who may not be experienced with electrical connectors or wiring, and under challenging circumstances, uncomfortable weather or difficult working conditions.

In addition, in use, truck boxes and trailers experience extreme ambient temperatures combined with moisture, constant high winds, direct sunlight, road salt, and de-icing or other chemicals. As a result, junction boxes, and wiring, ring terminals and other connections on the truck boxes or trailers are subject to corrosion and relatively high failure rates over time. Hence, conventional wiring arrangements on truck boxes and trailers present a number of problems.

SUMMARY OF THE INVENTION

It is an object of the invention to provide a corrosion resistant wiring system for truck boxes and trailers.

It is another object of the invention to provide a system of easy to connect cables that will stay securely connected.

It is yet another object of the invention to provide a multi-port junction block for the trailer environment.

It is a further object of the invention to provide a wiring system that can easily accommodate additional electric motors or devices on the truck box or trailer.

It is yet a further object of the invention to provide a wiring system with reduced need for multiple and expensive cables traversing the same channels.

It is yet an additional object of the invention to provide a wiring system accomplishing a combination of two or more of the objects previously mentioned.

Other systems, methods, features and advantages of the invention will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

In order to better appreciate how the advantages and objects of the inventions are obtained, a more particular description of the system, arrangement, connectors and junction block briefly described above will be rendered by reference to specific embodiments thereof and illustrated in the accompanying drawings. It should be noted that the components in the figures are not necessarily to scale, emphasis instead being placed upon illustrating the principles of the invention. Moreover, in the figures, like reference numerals designate corresponding parts throughout the different views. However, like parts do not always have like reference numerals. Moreover, all illustrations are intended to convey concepts, where relative sizes, shapes and other detailed attributes may be illustrated schematically rather than literally or precisely.

DETAILED DESCRIPTION OF THE PREFERRED EMBODIMENTS

Figure 1:
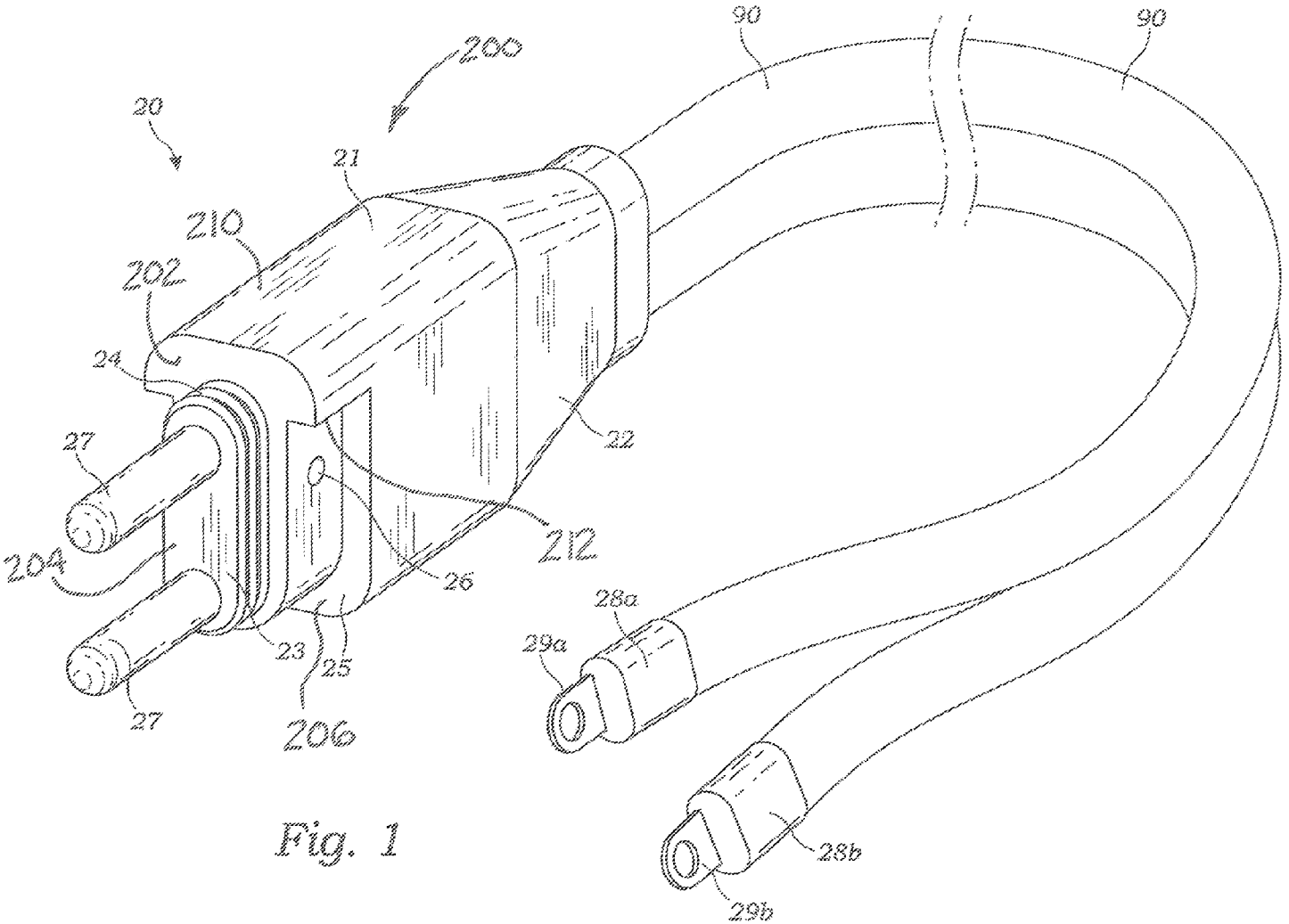
FIG. 1 is a perspective view of a male electric cable connector and cable with terminal rings according to an embodiment of the present invention.
Figure 2:
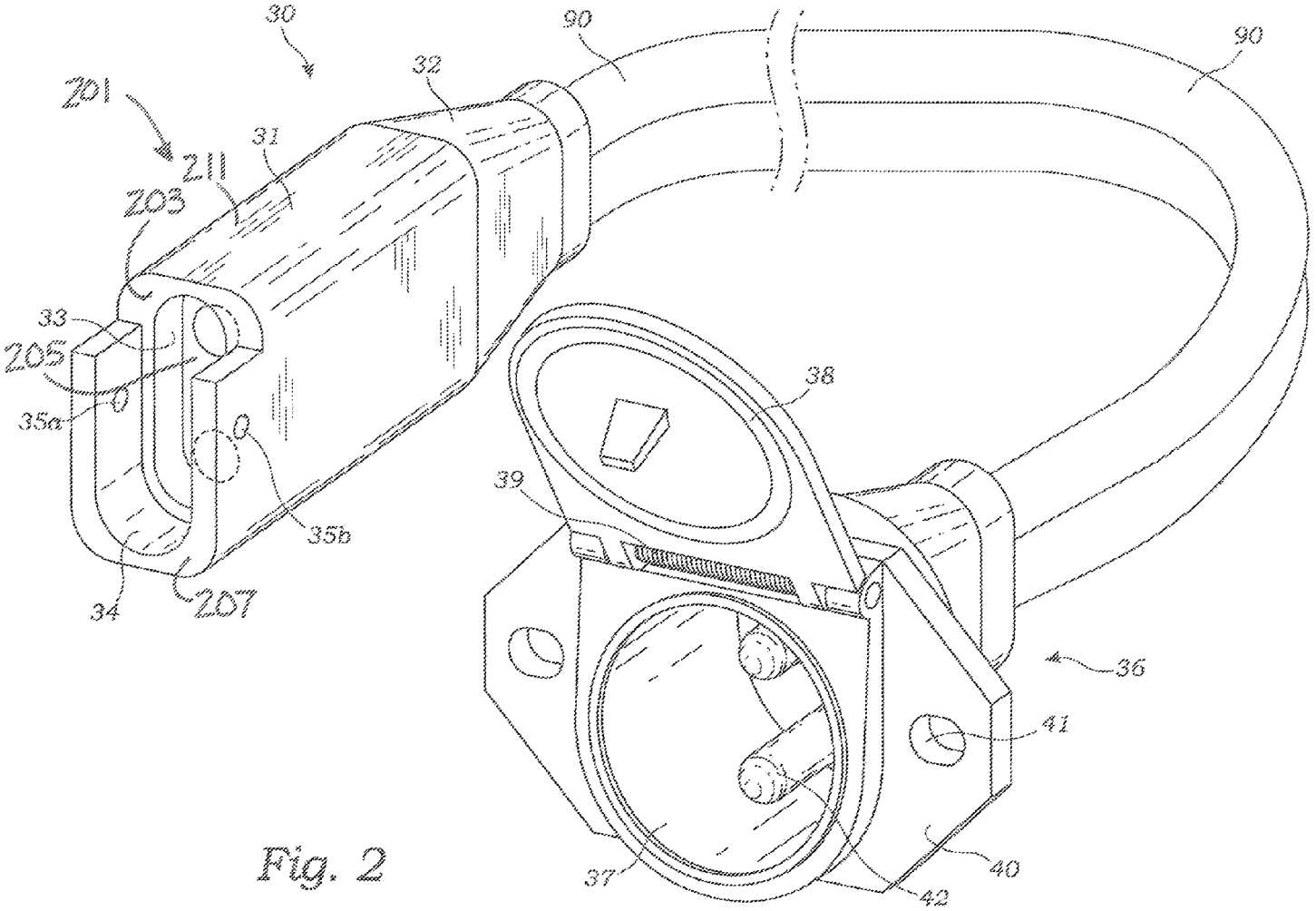
FIG. 2 is a perspective view of a female electric cable connector and cable with male trailer connector according to an embodiment of the present invention.
Figure 3:
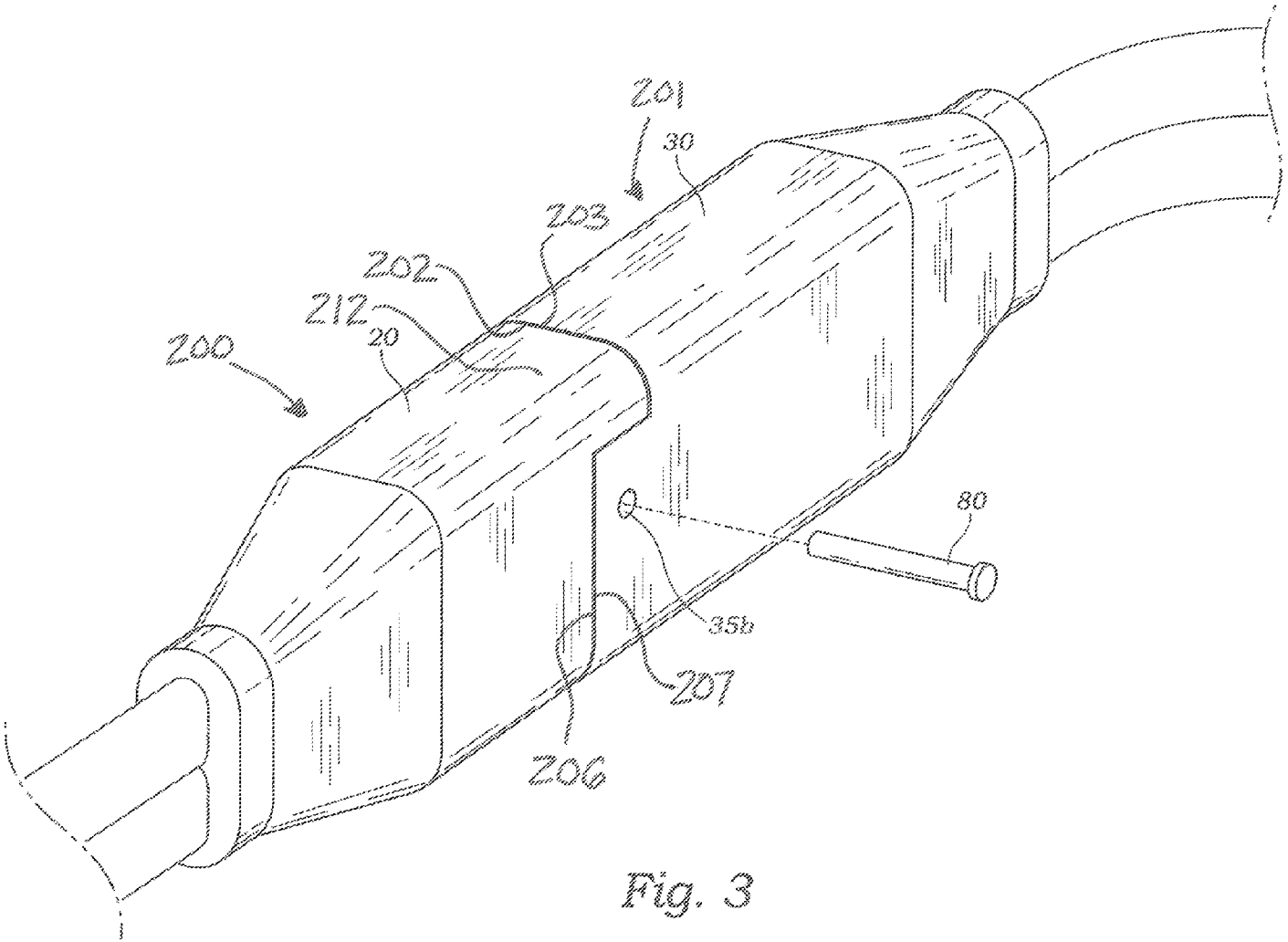
FIG. 3 is a perspective view of a male cable connector mated with female cable connector, secured together with a lock pin according to an embodiment of the present invention.
Figure 4:
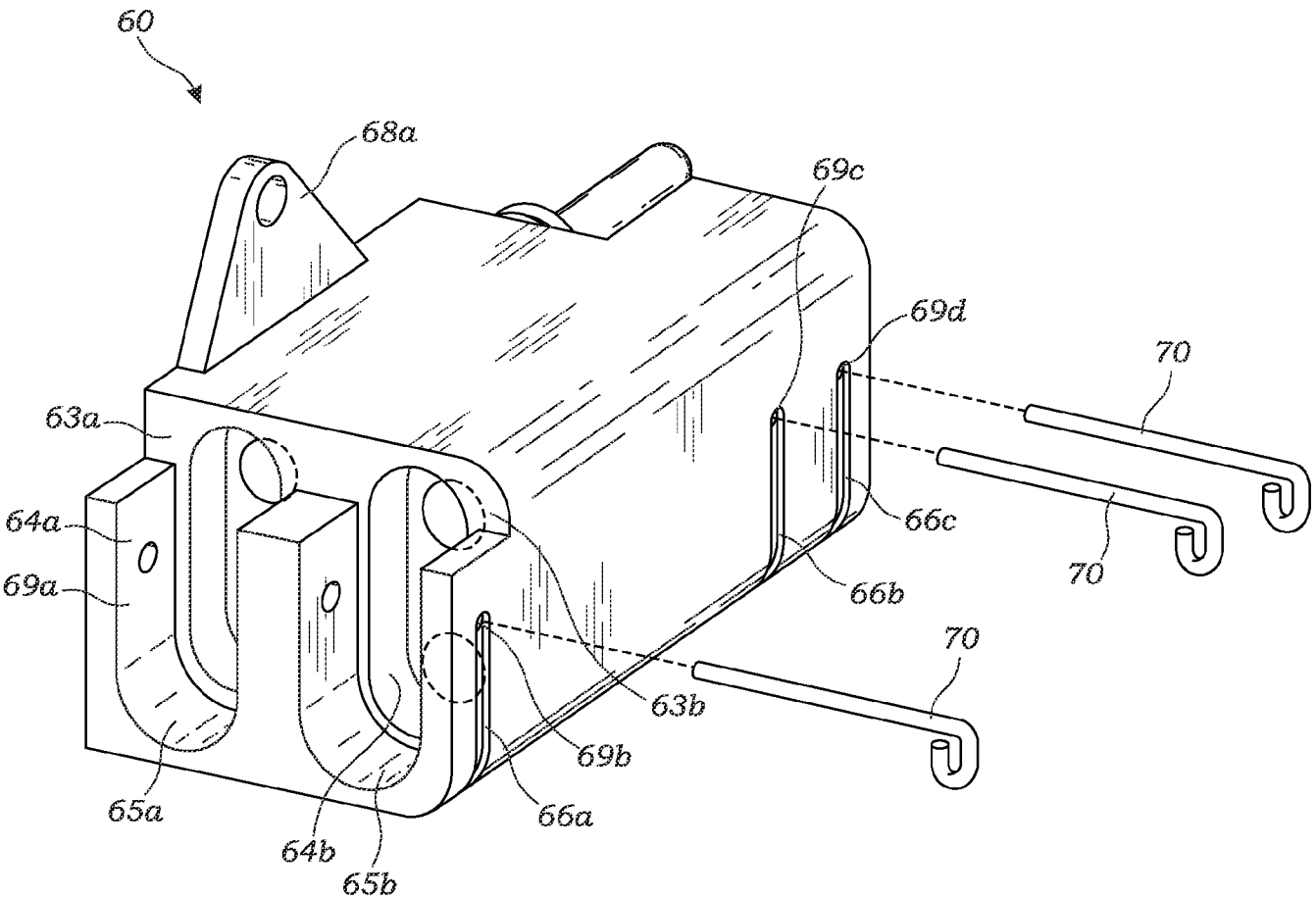
FIG. 4 is a perspective view of a multi-port junction block according to an embodiment of the present invention.
Figure 5:
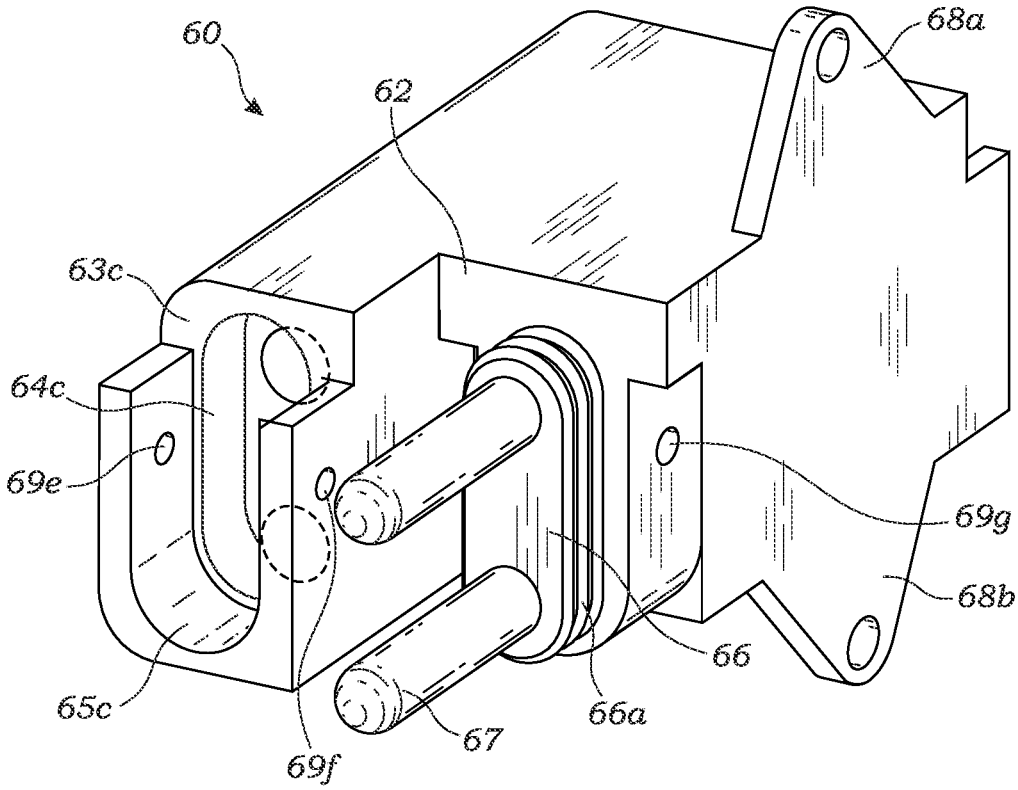
FIG. 5 is a second perspective view of a multi-port junction block according to an embodiment of the present invention.
Figure 6:
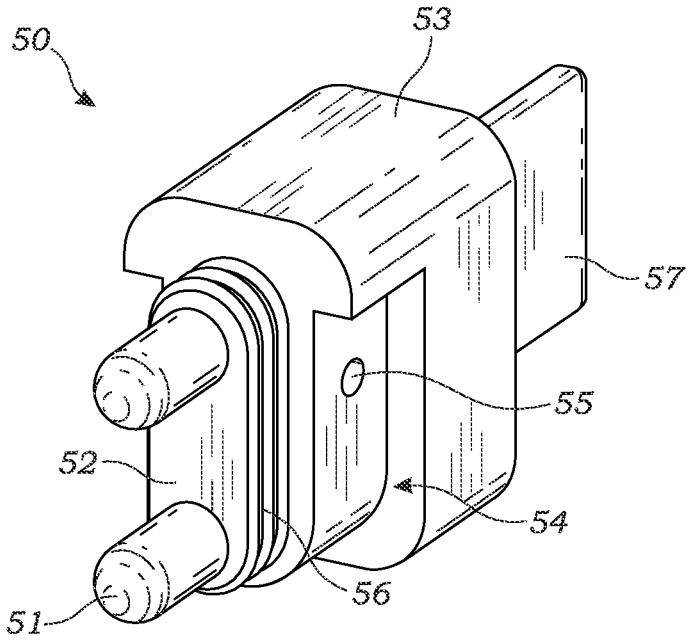
FIG. 6 is a perspective view of a male plug according to an embodiment of the present invention.
Figure 7:
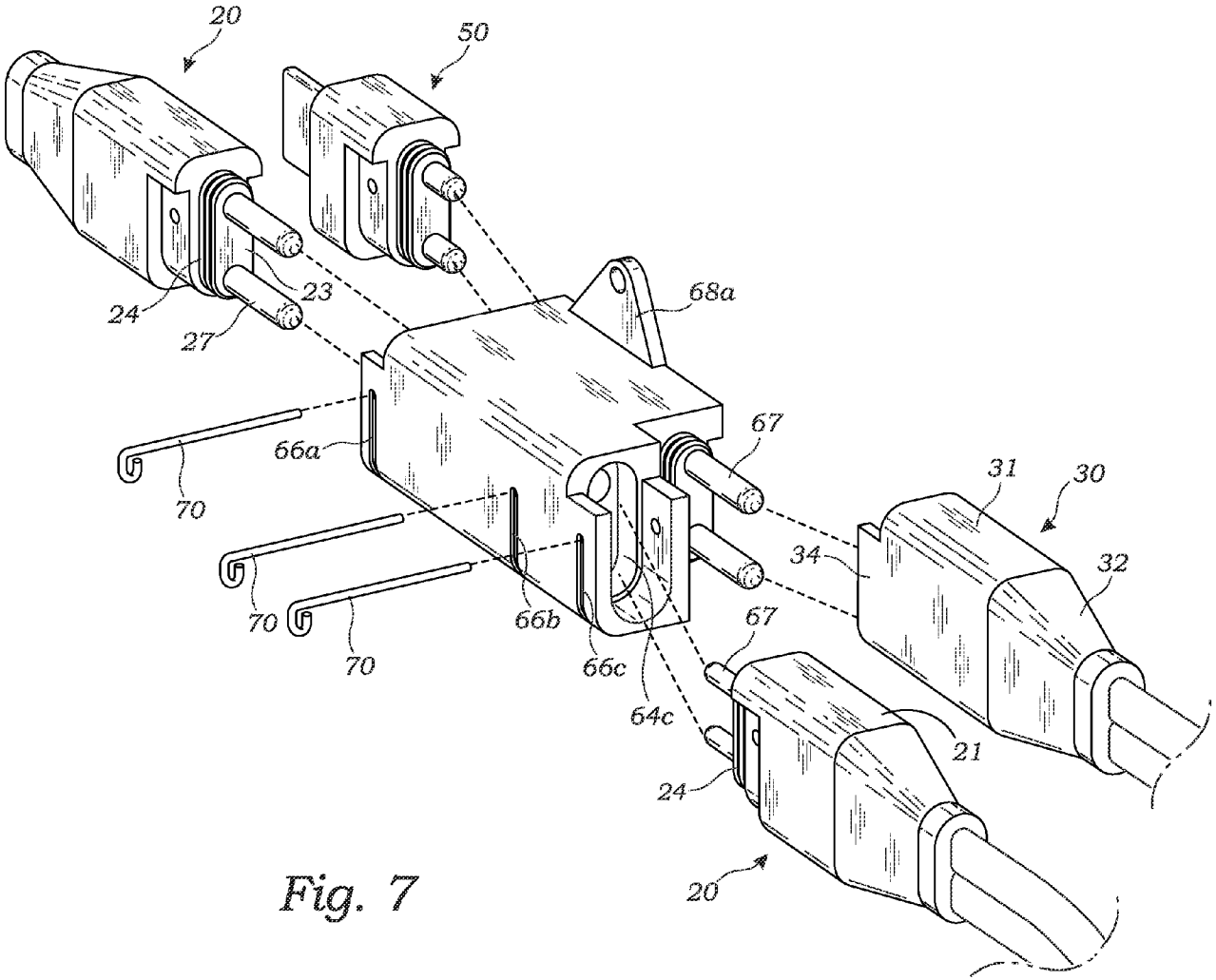
FIG. 7 is a perspective view of a system of electrical male cable connectors, an electrical female cable connector, a male plug, and a junction block and lock pins according to an embodiment of the present invention.

In general, FIG. 1 shows a male connector 200 on an end of a cable in an unmated condition, and FIGS. 5, 6, and 7 show a male connector on other structures such as on a junction block. FIG. 2 shows a female connector 201 on an end of a cable in an unmated condition, and FIGS. 4, 5, and 7 show a female connector on other structures such as on a junction block. FIG. 3 shows the male 200 and female 102 connectors moved into a mated condition. The male connector 200 includes a male primary interface surface 202 (see FIG. 1) and the female connector 201 includes a female primary interface surface 203 (see FIG. 2) which are brought toward each other and may converge with each other as shown in FIG. 3. The male primary interface surface 202 and the female primary interface surface 203 may define a primary interface plane that generally extends along each of the surfaces 202, 203. The male connector 200 may also include a male secondary interface surface 204 (see FIG. 1) and the female connector 201 may include a female secondary interface surface 205 (see FIG. 2) which are brought toward each other and may converge with each other as shown in FIG. 3. The male secondary interface surface 204 and the female secondary interface surface 205 may define a secondary interface plane that generally extends along each of the surfaces 204, 205. The male connector 200 may further include a male tertiary interface surface 206 (see FIG. 1) and the female connector 201 may include a female tertiary interface surface 207 (see FIG. 2) which are brought toward each other and may converge with each other. The male tertiary interface surface 206 and the female tertiary interface surface 207 may define a tertiary interface plane that generally extends along each of the surfaces 206, 207.

Referring to FIG. 1, an electrical male cable connector 20 is shown. The mate cable connector 20 includes a male body 210 that may be molded with a weather resistant and electrically insulating (or electrically non-conducting) material such as hard plastic, preferably polyvinylchloride (PVC) rubber. The male cable connector 20 has a generally rectangular portion 21 in the center being about 1.4 inches from front to back, about 1.4 inches from top to bottom, and about 0.8 inches thick, a rear portion 22 tapering toward the rear, and a projection portion 23 that is generally oblong and about 0.3 inches from front to back, 1 inch top to bottom, and about 0.3 inches thick. The general shape and dimension of the male cable connector 20 is adapted to fit into and through the wiring channels of truck boxes or trailers.

Because the male cable connector 20 has two conductor wiring (positive and negative), in order to assist in the correct mating of the male cable connector 20 to a female cable connector 30 (FIG. 2) or a female block connector of the junction block 60 (FIGS. 4 and 5), the center portion 21 of the male body 210 of the male cable connector 20 has a front generally U-shaped cutout or recess 25 that extends about a portion of the male primary interface surface 202 with a key 212 being positioned about the remaining portion of the primary interface surface 202. The recess 25 may be about 0.25 inches in depth to receive a matching portion of the female connector 30 or the female block connector of the junction block 60. The front U-shaped cutout or recess 25 starts at about 0.4 inches from the top (same end having positive conductor) of the center portion 21 of the male cable connector 20. The front U-shaped cutout or recess 25 has an aperture 26 with its center being about halfway between the top and bottom of the male cable connector 20, and about halfway between the front edge of the center portion 21 to the wall of the cutout or recess. The aperture 26 is for inserting a harness lock pin 80 (FIGS. 3 and 7) when the male cable connector 20 is mated with a female cable connector 30 (FIG. 2), or with a female block connector of the junction block 60 (FIGS. 4 and 5), as further described below.

The generally oblong projecting portion 23 of the male cable connector 20 may project or protrude from the male primary interface surface 202 in a manner such that the projecting portion is received in the passageway 33 of the female body 211, so that both the portion 23 and the passageway extend in a first direction and to a first side of the primary interface plane generally corresponding to the interface surface 202 when the connectors 200, 201 are in the mated condition. The protruding portion 23 may have the male tertiary interface surface 206. The projecting portion 23 is fitted on the outside with a gasket or seal 24, preferably fabricated in a resilient sealing material, e.g., silicone, to create a seal between the male cable connector 20 and a female cable connector 30 (FIG. 2) or a female block connector 63 of a junction block 60 (FIGS. 4 and 5). The seal surrounds the projecting portion 23 and prevents moisture from entering the connectors when the male cable connector 20 is mated with the female cable connector 30, or with the female block connector 63 of the junction block 60. The gasket 24 has two grooves separating and defining three ridges, and is made of resilient material, allowing it to be freely removed and replaced, if necessary.

Alternatively, sufficient sealing could be accomplished in other ways. For example, the oblong projecting portion 23 could have one or more grooves that encircle it, in which one or more resilient bands of rubberized material (circular in cross-section) could reside. In this way, any gap between the oblong projecting portion 23 of the male cable connector 20 and the passageway 33 of the female cable connector 30 would be sealed, thereby preventing or at least reducing the risk that dust, dirt, moisture or other impurities or reactants would contact the prongs or other electrical components when they are electrified. This reduces corrosion of the wiring components.

To support high current electricity, the male cable connector 20 has at least two precision, electrically conductive connecting prongs 27, preferably made of brass, capable of carrying 0-200 amps of current. Each prong 27 has an end communicating with the oblong projecting portion 23, and a distal end. The ends of the prongs 27 communicating with the male cable connector 20 are crimped (or soldered or both) on the electric cables 90 during manufacturing. The electric cables 90 are preferably fabricated using 6 American Wire Gauge (AWG) standard copper wires. In order to assist in the correct installation of the male cable connector 20 and the molded cables 90 to an electrical source or equipment, the jacket of the cables 90 are marked such that the positive conductor wire will have a jacket with a red color stripe.

During manufacture, the electrical cables 90 are molded to the male cable connector 30. The jacket of the electrical cables 90 is made of the same electrically insulating material as with the male cable connector 20. As such, the male cable connector 20 fuses together with the jacket of the electrical cables 90. At the distal end of the cables 90, two terminal rings 29*a*/29*b* are crimped (or soldered) onto the cables. The crimped ends of the terminal rings 29*a*/29*b* are wrapped in color coded electrically insulating jacket 28*a*/28*b*. Red color is used for the jacket 28*a* wrapping the ring 29*a* that terminates the positive conductor wire. Black color is used for the jacket 28*b* wrapping the ring 29*b* that terminates the negative conductor wire. The terminal rings 29*a*/29*b* are ready for connecting the cables 90 to electric motors and devices.

Referring to FIG. 2, the female connector 201, in the form of a female cable connector 30, includes a female body 211 that may be molded with a weather resistant and electrically insulating (or electrically non-conducting) material such as hard plastic, preferably polyvinylchloride (PVC) rubber. The female connector 30 has a generally rectangular center portion 31 being about 2 inches from front to back, about 1.4 inches from top to bottom, and about 0.8 inches thick, a rear portion 32 tapering toward the rear. The female body 211 may have a generally U-shaped flange 34 in the front extending from the female primary interface surface and the primary interface plane, and the flange 34 may form a key slot 213 for receiving the key 212 when the connectors are in the mated condition so that both the flange 34 and the key slot in a second direction and to a second side of the primary interface plane. The U-shaped flange 34 may have free ends which define the edges of the key slot 213. The general shape and dimension of the female connector 30 is adapted to fit into and through the wiring channels of truck boxes or trailers.

The U-shaped flange 34 contains bilateral apertures 35*a* and 35*b* on opposing sides. The apertures 35*a*/35*b* have passages such that a single cylindrical pin with appropriate dimensions can pass through both. The application of the apertures and associated pin is further described below.

Similar to the male cable connector 20, during manufacture, the electrical cables 90 are molded to the female cable connector 30. The jacket of the electrical cables 90 is made of the same electrically insulating material as with the female cable connector 30.

For safety purposes, generally throughout the invention contemplated herein, the male connectors are intended to be connected to hot female connectors. In this way, the exposed prongs of the male connectors are not carrying a charge that could injure a handler and damage equipment. On the other hand, the electrical components of the female connectors are recessed out of the way of inadvertent contact with hands, clothes or equipment. The arrangements described herein, when used, have electrical components well covered at the point where the connections are made, reducing the risk of sparking, shock, injury or property damage during the connection and disconnection operations.

The U-shaped flange 34 on the female connector provides additional shielding against inadvertent contact with hot wires, or ground, or inadvertent sparks at the point of connection. However, the U-shaped flange and corresponding U-shaped space 25 on the male connector could be reversed such that the male connector included a U-shaped flange and the female connector included a U-shaped space. Such as arrangement would continue to provide some of the benefits contemplated herein.

In order to assist in the correct mating of the male and female connectors, such as the female cable connector 30 to a male cable connector 20 (FIG. 3) or the male block connector of the junction block 60 (FIGS. 4 and 5), the female cable connector 30 has a front generally U-shaped flange 34 being about 0.4 inches from front to back, and a passageway 33. The passageway 33 receives the front protruding portion 23 of the male cable connector 20 when the male cable connector 20 is mated with the female cable connector 30. The U-shaped flange 34 of the female body fits into the front U-shape cutout or recess 25 of the male body when the male cable connector 20 is mated with the female cable connector 30. In the mated condition of the connectors, the flange 34 and the key 212 may form a continuous perimeter (see FIG. 3). Also in the mated condition, both the recess 25 and key 212 of the male body and the flange 34 and the key slot 213 may be located on the second side of the primary interface plane, which is opposite of the first side of the primary interface plane where the protruding portion 23 and passageway 33 are located. The female cable connector 30 includes at least two electrically conductive sockets or openings adapted to fit the opposing electrically conductive connecting prongs 27 of a male cable connector 20 or the opposing electrically conductive connecting prongs 67 a male block connector 62 (FIG. 5).

The end of cable 90 opposite of the female cable connector 30 can be either a male cable connector, for example, if needed to be used as an extension between other male and females connections in the system. However, that end could also include a different component. As shown in FIG. 2, the other end contains a trailer male connector 36.

Trailer male connector 36 is molded to cable 90 as described above for male connector 20 and female connector 30. It contains a cylindrical passageway 37 exposing prongs 42. A cap 38 is pivotally hinged to the trailer male connector 36, with spring 39 communicating between the two to bias the cap 38 to a position to cover the passageway 37. When the trailer male connector is in use, the cap 38 will rest against the female connector mated with the trailer male connector 36. However, when there is no mated connection, the cap 38 is held by the spring tightly against the passageway 37 entry, creating a moisture and duct proof seal.

The trailer male connector contains two, bilateral flanges 40 with apertures 41. Screws or bolts (not shown) can pass through the apertures to secure the trailer male connector 36 to the sidewall or other structure in the truck box or trailer. The use of the trailer male connector 36 with other components in a trailer electrical system is described in more detail below.

Referring to FIG. 3, the male cable connector 20 is mated with the female cable connector 30. The harness lock pin 80 is inserted to secure the male cable connector 20 to the female cable connector 30. The harness lock pin 80 goes through aperture 35*b* (FIGS. 2 and 3) of the female cable connector 30, aperture 26 (FIG. 1) of the male cable connector 20, and aperture 35*a* (FIG. 2) of the female cable connector 30. As such, when the harness lock pin 80 is in place through apertures 35*a*, 26, and 35*b*, it holds male cable connector 20 and female cable connector 30 securely together against pulling forces on the cable.

Referring to FIGS. 4 and 5, the junction block 60 is molded with a weather resistant, electrically insulating (or electrically non-conducting) material such as hard plastic, preferably polyvinylchloride (PVC). The junction block 60 has a generally rectangular center portion 61 configured to fit in the appropriate places in a truck box or trailer. Preferably it is about 3 inches from front to back, about 1.4 inches from top to bottom, and about 1.8 inches thick. The junction block 60 is shown with one male block connector 62 and three female block connectors 63*a*/63*b*/63*c*.

Each female block connectors 63*a*/63*b*/63*c* are constructed to receive male cable connector 20 (FIG. 1). As such, the construction of each of the three female block connectors 63*a*/63*b*/63*c* is generally correlating to the construction of the female connector 30. Each female block connector 63*a*/63*b*/63*c* has a passageway 64*a*/64*b*/64*c* which is generally similar to the passageway 33 of the female connector 30. Each female block connector 63*a*/63*b*/63*c* has a generally U-shaped flange 65*a*/65*b*/65*c* which is generally similar to the flange 34 of the female connector 30. Each female block connector 63*a*/63*b*/63*c* also has an aperture 69*a*/69*b*/69*e*/69*f* similar to apertures 35*a*/35*b* of the female connector 30.

The center portion 61 of the junction block 60 has a cutout for the male block connector 62. The male block connector 62 of the junction block 60 is constructed to fit into the female cable connector 30. As such, the construction of the male block connector 62 is generally similar to the construction of the male cable connector 20. The male block connector 62 has a front oblong portion 66 that is generally are to the front Oblong portion 23 of the male cable connector 20. The front portion 66 is also fitted with on the outside with a seal or gasket 66*a*. The male block connector 62 also has an aperture to receive a harness lock pin when the male block connector 62 is orated with a female cable connector 30. The construction of prongs 67 of the male block connector 62 is generally similar to the construction of prongs 27 of the male cable connector 20.

In the past, soft rubber was typically used to provide electric insulation and an adequate seal between two electrical connections. However, soft rubber is expensive to use and has other undesirable characteristics. The presently contemplated connections obtain comparable seals with the use of hard plastic, preferable polyvinylchloride, for the connector and block material, but with a resilient seal or gasket of softer material to seal the space between the male connector's oblong projecting portion and the female connector's passageway.

The junction block 60 has two generally triangular support flanges 68*a*/68*b* at the top and bottom. The two flanges 68*a*/68*b* are flushed against the back all of the junction block 60 and have apertures so that the junction block 60 can be mounted, using screws (not shown) to a truck box trailer wall or other support or platform.

The junction block 60 has three slots 66*a*/66*b*/66*c* on the front wall. Two outside grooves are extended downward from the apertures 69*b* and 69*d* on the flanges 65*b* and 65*c* of the female block connectors 63*b* and 63*c* to the bottom wall of the junction block 60. One inside slot 66*b* is extended from the inside aperture 69*c*, which is aligned with the apertures 69*g* (FIG. 5) on the male block connector 62, to the bottom wall of the junction block 60. A harness lock pin 70 can be inserted into each of the apertures when a male cable connector 20 is mated with the female block connector 63*a*/63*b*/63*c*, or when a female cable connector 30 is mated with the male block connector 62. The harness lock pin 70 has a loop at one end. A portion of the loop of the harness lock pin 70 fits into the slots 66*a*/66*b*/66*c* when the harness lock pin 70 is inserted into one of the three apertures from where the slots extend. The slots are under-cut to provide an interference fit with the loop of the pins. This retains the pin in place and prevents rotation of the pin and inadvertent movement of the pin out of the aperture until the pin is at least partially withdrawn from the slots 66*a*/66*b*/66*c*.

Referring to FIG. 6, a male plug 50, molded with a weather resistant and electrically insulating material, preferably polyvinylchloride (PVC) rubber, is used to plug into a finale block connector 63*a*/63*b*/63*c* when the female block connector 63*a*/63*b*/63*c* is not mated with a male connector 20. As described herein, the junction block additional electrical connections are easily added to accommodate to new electric motors or other devices on the truck box or trailer.

The junction block 60 has three female block connectors, providing for connections to three independent electrical motors or devices. The positive input voltage supplied to one of the two pins of the male block connector 62 communicates electrically (through conductive structures within the junction block) with the corresponding positive output sockets on the female block connectors 63*a*/63*b*/63*c*. Similarly, the ground pin of the male block connector 62 communicates electrically with the corresponding ground socket of the female block connectors 63*a*/63*b*/63*c*.

The junction block may be initially installed with one or two unused female block connections, providing the potential easy wiring connection to retrofit electrical devices that are added later. In order to prevent the female block connectors from being exposed to the harsh ambient environment, a male plug 50 is used. In order to provide an efficient seal, it has a shape that generally matches the male cable connector. In particular, the preferred embodiment has two dummy prongs 51, a generally oblong front portion 52, a center portion 53 with a generally U-shaped cutout 54 for receiving the generally U-shaped flange 65*a*/65*b*/65*c* of the female block connector 63*a*/63*b*/63*c*, and an aperture 55 for receiving a harness lock pin 70. If needed, the male plug 50 could be used to seal the unused, open end of a female cable connector.

As mentioned above, the U-shaped flange associated with the female cable connectors, and U-shaped space associated with the male cable connectors could be reversed. If such an arrangement was used, the junction block could be similarly modified such that a U-shaped flange would be associated with the male block connector 62 and U-shaped spaces would be associated with the female block connectors 63*a*/63*b*/63*c*. This arrangement still allows (1) for female cable connectors to mate with male cable connectors and male block connectors, and (2) for male cable connectors to mate with female cable connectors and female block, connectors. Such junctions can be secured with the use of a lock pin placed in the aligned apertures in the U-shaped flanges and projecting portions.

As generally contemplated herein, a female plug (not shown) having a similar shape as the female cable connector could be utilized to seal the male block connector. The preferred embodiment of the junction block contemplated herein has only a single male block connector that in most cases would be used from the time of initial installation because it functions to bring power into the junction block. However, in the relatively unusual occasion where the single male block connector is unused or a junction block contains an unused second male block connector, a female plug could be utilized. If needed, the female plug could be used to seal the unused, open end of a female cable connector.

Referring to FIG. 7, the system of connector and multi-port junction block is shown in a preferred embodiment. As described above, the junction block 60 can be mated with up to three male cable connectors 20 and one female cable connector 30 at the same time. When a male cable connector 20 is not used or needed, a male plug 50 can be mated with the female block connectors 63*a*/63*b*/63*c* of the junction block 60 in order to prevent moisture, dust, or other contaminants from entering the junction block 60. Harness lock pins 70 are used to secure male cable connector 20, female cable connector 30, and male plug 50 to the junction block 60. Screws (not shown) are placed through the apertures in flanges 68*a*/68*b* to attach the junction block 60 to a trailer wall or other support structure on the trailer.

Figure 8:
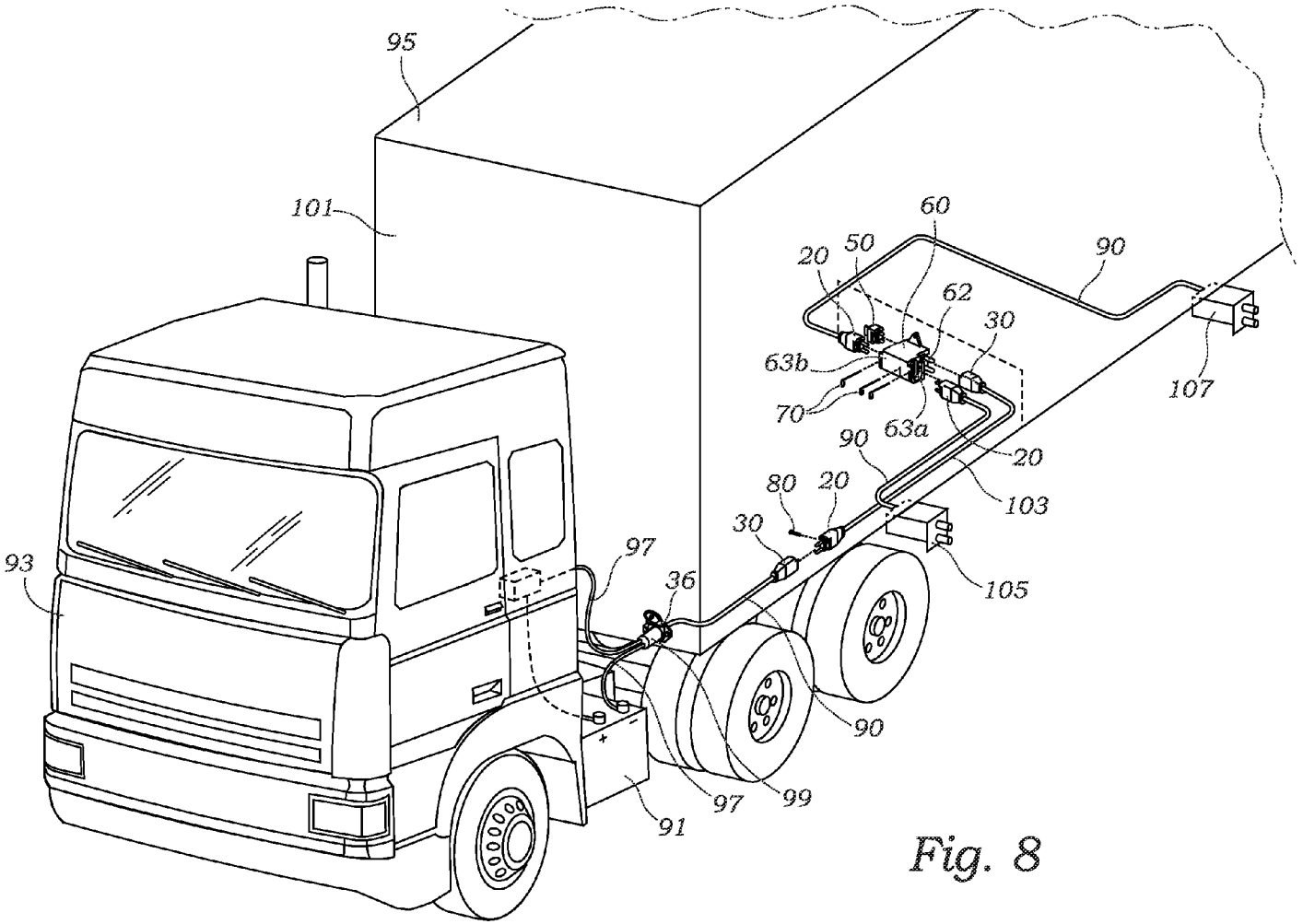
FIG. 8 is a perspective view of a truck cab and trailer including a system of a battery, cables, cable connectors and a junction block according to an embodiment of the present invention.

Persons who build, use and work on truck boxes and trailers will appreciate that there are a variety of possible arrangements of the cables, connectors and junction block described above. FIG. 8 shows merely one way in which they could be used together in a truck box or trailer. However, many other ways are contemplated and accomplishable with the information contained in herein.

With respect to the embodiment of FIG. 8, a battery 91 residing in a truck cab 93 provides electricity to run devices on an associated trailer 95. Electrical wires 97 can power from the battery 91 in the cab 93 to the trailer 95. They include an electrical female connector 99 that mates with a trailer male electrical connector 36 mounted on the front wall 101 of the trailer 95. This connection is easily reversible to facilitate swapping of trailers and cabs. When connected, the electrical system on the trailer becomes energized.

The trailer male connector 36 has a cable 90 and female cable connector 30 of the type shown in FIG. 2 on its opposite end. An extension cable 103 brings power to the junction block. It has at one end a male cable connector 20 of the type shown in FIG. 1 and, at the other end a female cable connector 30 of the type shown in FIG. 2. The male end 20 mates with the female end 30 of cable 90 connected to the male trailer connector 36 at the front wall 101 of the trailer 95. The female end 30 mates with junction block 60 at the male block connector 62 of the type shown in FIG. 5. A harness lock pin 70 of the type shown in FIGS. 4 and 7 secures the connection against inadvertent disconnection due to pulling on the wires or plugs. This completes the wiring that brings electricity from the battery 91 to the junction block 60.

The electrical power is then distributed from the junction block 60 to two hopper door motors, a forward hopper door motor 105 and a rearward hopper door motor 107. Forward hopper door motor 105 is connected to a cable 90 by use of terminal rings 29*a*/29*b* of the type shown in FIG. 1 (not shown in FIG. 8). The other end of the cable contains a male cable connector 20. The male cable connector 20 is mated with a female block connector 63*c* in the junction block 60 to create a sealing connection. A harness lock pin 70 of the type shown in FIGS. 4 and 7 secures the male cable connector 20 to the female block connector 63*c*.

Similarly, the rearward hopper door motor 107 is connected to a cable 90 by use of terminal rings 29*a*/29*b* of the type shown in FIG. 1 (not shown in FIG. 8). The other end of the cable contains a male cable connector 20. The male cable connector 20 is mated with a female block connector 30 in the junction block 60 to create a sealing connection. A harness lock pin 70 of the type shower FIGS. 4 and 7 secures the male cable connector 20 to the female block connector 63*b*.

The two male cable connectors 20, along with a female cable connector 30, are no secured in the two female block connectors 63*b* and 63*c*, and one male block connector 62 in the junction block 60. This leaves one unused female block connector 63*a* in the junction block that is available to be connected and bring power to a later-added electrical device on the trailer. This is easily accomplished by merely connecting the new device to terminal rings 29*a*/29*b* at one end of a cable 90 and a male cable connector 20 at the other end. However, until that additional device is added, a protective plug 50 is inserted into the unused female block connector 63*a* to protect it against the ambient environment and reduce any corrosion that could occur at the metal electrical surfaces.

Multiple junction blocks 60 can be utilized on a single trailer to provide the potential to provide power to five or more motors or other devices. This is accomplished by attaching additional junction blocks 60 to the trailer 95.

The two junction blocks are connected by using an extension cable with a male cable connector 20 on one end and a female cable connector on the other end. The male connector 20 is mated with an unused female block connector, for example 63*a* in FIG. 8, and the female cable connector 30 is mated with the male block connector 62 of a second junction block (not shown). This brings power to the second junction block and makes an additional three female block connectors available to be connected with and energize three additional motors or devices.

In the foregoing specification, the invention has been described with reference to specific embodiments thereof. It will, however, be evident that various modifications and changes may be made thereto without departing from the broader spirit and scope of the invention. Additionally and obviously, features may be added or subtracted as desired. Accordingly, the invention is not to be restricted except in light of the attached claims and the equivalents.

What is claimed is:

1. A corrosion resistant connection system, comprising:

a male connector and a female connector configured to move together in a longitudinal direction into a mated condition and being movable in an opposite longitudinal direction from the mated condition into an unmated condition, a primary interface plane being defined at a convergence of primary interface surfaces of the male and female connectors in the mated condition, a secondary interface plane being located in one said longitudinal direction from the primary interface plane and a tertiary interface plane being located in an opposite said longitudinal direction from the primary interface plane;

wherein the male connector has at least two electrically-conductive prongs and a male body formed of a non-conductive material, longitudinal axes of the prongs being oriented substantially parallel to the longitudinal direction, the male body having a male primary interface surface lying substantially in the primary interface plane;

wherein the female connector has at least two electrically-conductive sockets and a female body formed of a non-conductive material, the sockets extending into the female body of the female connector, the female body having a female primary interface surface lying substantially in the primary interface plane for positioning adjacent to the male primary interface surface in the mated condition of the connectors;

wherein the male body of the male connector has a projecting portion protruding from the male primary interface surface, the female body of the female connector having a passageway configured to receive the projecting portion of the male body in the mated condition, the passageway extending into the female primary interface surface toward the secondary interface plane;

wherein the projecting portion and the passageway are located between the primary interface plane and the secondary interface plane in the mated condition of the connectors;

wherein the male body of the male connector has a recess extending about a portion of the male primary interface surface and a key extending about a remainder portion of the male primary interface surface;

wherein the female body of the female connector has a flange configured to be received in the recess of the male body of the male connector in the mated condition, the flange defining a key slot configured to receive the key when the connectors are in the mated condition such that the flange and the key form a continuous perimeter when the connectors are in the mated condition; and wherein the recess and the key of the male body and the flange and key slot of the female body are located between the primary interface plane and the tertiary interface plane in the mated condition of the connectors.

2. The system of claim 1 wherein the male body includes:

a male secondary interface surface lying substantially in the secondary interface plane, the at least two prongs extending outwardly from the male body at the male secondary interface surface a male tertiary interface surface lying substantially in the tertiary interface plane;

wherein the female body includes:

a female secondary interface surface lying substantially in the secondary interface plane for positioning adjacent to the male secondary interface surface in the mated condition, the at least two sockets extending into the female secondary interface surface; and a female tertiary interface surface lying substantially in the tertiary interface plane for positioning adjacent to the male tertiary interface surface in the mated condition.

3. The system of claim 2 wherein the primary interface plane, the secondary interface plane and the tertiary interface plane are oriented substantially parallel to each other.

4. The system of claim 2 wherein the primary interface plane, the secondary interface plane, and the tertiary interface plane are oriented substantially perpendicular to the longitudinal direction.

5. The system of claim 1 wherein the flange of the female body has a substantially U-shaped configuration with a pair of legs defining the key slot therebetween.

6. The system of claim 1 wherein the recess of the male body has a substantially U-shaped configuration with the key being located between ends of legs of the recess.

7. The system of claim 1 wherein the flange of the female body is formed by a wall with a substantially uniform thickness between ends.

8. The system of claim 1 wherein the projecting portion of the male body and the passageway of the female body are sized and shaped to produce a seal between the connectors in the mated condition of the connectors.

9. The system of claim 1 wherein the mated condition of the connectors is characterized by an electrical connection being formed between the prongs and sockets of the connectors and the unmated condition being characterized by an electrical connection not being formed between the connectors.

10. The system of claim 1 wherein the projecting portion of the male body and the passageway of the female body are elongated in a direction parallel to a plane including the longitudinal axes of the prongs.

11. The system of claim 1 additionally comprising a gasket extending continuously about the projecting portion of the male body in a plane oriented substantially parallel to the primary interface plane.

12. The system of claim 1 wherein an aperture is formed through the flange of the female body and into the male body, the aperture being configured to removably receive a lock pin to lock the male body and female body together.

13. The system of claim 12 wherein the flange of the female body is substantially U-shaped, and a said aperture extends through two locations on the flange located on opposite sides of the male body, the apertures in the flanges and the male body being configured to simultaneously and removably receive the lock pin to lock the male body and female body together.

14. A corrosion resistant connection system, comprising:

a male connector and a female connector configured to move together in a longitudinal direction into a mated condition and being movable in an opposite longitudinal direction from the mated condition into an unmated condition, a primary interface plane being defined at a convergence of primary interface surfaces of the male and female connectors in the mated condition, a secondary interface plane being defined at a convergence of secondary interface surfaces of the connectors in the mated condition, a tertiary interface plane being defined at a convergence of tertiary interface surfaces of the connectors in the mated condition, the tertiary interface plane being located on an opposite side of the primary interface plane from the secondary interface plane;

wherein the male connector has at least two electrically-conductive prongs and a male body formed of a non-conductive material, longitudinal axes of the prongs being oriented substantially parallel to the longitudinal direction, the male body having:

a male primary interface surface lying substantially in the primary interface plane;

a male secondary interface surface lying substantially in the secondary interface plane, the at least two prongs extending outwardly from the male body at the male secondary interface surface a male tertiary interface surface lying substantially in the tertiary interface plane;

wherein the female connector has at least two electrically-conductive sockets and a female body formed of a non-conductive material, the sockets extending into the female body of the female connector, the female body having:

a female primary interface surface lying substantially in the primary interface plane for positioning adjacent to the male primary interface surface in the mated condition;

a female secondary interface surface lying substantially in the secondary interface plane for positioning adjacent to the male secondary interface surface in the mated condition, the at least two sockets extending into the female secondary interface surface;

a female tertiary interface surface lying substantially in the tertiary interface plane for positioning adjacent to the male tertiary interface surface in the mated condition;

wherein the male body of the male connector has a projecting portion protruding from the male primary interface surface and having the secondary interface surface formed thereon, the female body of the female connector having a passageway configured to receive the projecting portion of the male connector in the mated condition, the passageway extending into the female primary interface surface and forming the female secondary interface surface;

wherein the projecting portion and the passageway are located between the primary interface plane and the secondary interface plane in the mated condition of the connectors;

wherein the male body of the male connector has a recess extending about a portion of the male primary interface surface and a key extending about a remainder portion of the male primary interface surface;

wherein the female body of the female connector has a flange configured to be received in the recess of the male body of the male connector in the mated condition, the flange defining a key slot configured to receive the key when the connectors are in the mated condition such that the flange and the key form a continuous perimeter when the connectors are in the mated condition of the connectors.

15. The system of claim 14 wherein the recess and the key of the male body and the flange and key slot of the female body are located between the primary interface plane and the tertiary interface plane in the mated condition of the connectors.

16. The system of claim 14 wherein the flange of the female body has a substantially U-shaped configuration with a pair of legs defining the key slot therebetween.

17. The system of claim 14 wherein the recess of the male body has a substantially U-shaped configuration with the key being located between ends of legs of the recess.

18. The system of claim 14 wherein the flange of the female body is formed by a wall with a substantially uniform thickness between ends.

19. The system of claim 14 wherein the projecting portion of the male body and the passageway of the female body are sized and shaped to produce a seal between the connectors in the mated condition of the connectors.

20. The system of claim 14 wherein the mated condition of the connectors is characterized by an electrical connection being formed between the prongs and sockets of the connectors and the unmated condition being characterized by an electrical connection not being formed between the connectors.

21. The system of claim 14 wherein the primary interface plane, the secondary interface plane and the tertiary interface plane are oriented substantially parallel to each other.

22. The system of claim 14 wherein the primary interface plane, the secondary interface plane, and the tertiary interface plane are oriented substantially perpendicular to the longitudinal direction.

23. The system of claim 14 wherein the projecting portion of the male body and the passageway of the female body are elongated in a direction parallel to a plane including the longitudinal axes of the prongs.

24. The system of claim 14 additionally comprising a gasket extending continuously about the projecting portion of the male body in a plane oriented substantially parallel to the primary interface plane.

25. The system of claim 14 wherein an aperture is formed through the flange of the female body and into the male body, the aperture being configured to removably receive a lock pin to lock the male body and female body together.

26. The system of claim 25 wherein the flange of the female body is substantially U-shaped, and a said aperture extends through two locations on the flange located on opposite sides of the male body, the apertures in the flanges and the male body being configured to simultaneously and removably receive the lock pin to lock the male body and female body together.

27. A corrosion resistant connection system, comprising:

a male connector and a female connector configured to move together in a longitudinal direction into a mated condition and being movable in an opposite longitudinal direction from the mated condition into an unmated condition, a primary interface plane being defined at a convergence of primary interface surfaces of the male and female connectors in the mated condition;

wherein the male connector has at least two electrically-conductive prongs and a male body formed of a non-conductive material, longitudinal axes of the prongs being oriented substantially parallel to the longitudinal direction, the male body having a male primary interface surface lying substantially in the primary interface plane;

wherein the female connector has at least two electrically-conductive sockets and a female body formed of a non-conductive material, the sockets extending into the female body of the female connector, the female body having a female primary interface surface lying substantially in the primary interface plane for positioning adjacent to the male primary interface surface in the mated condition of the connectors;

wherein the male body of the male connector has a projecting portion protruding from the male primary interface surface in a first direction away from the primary interface plane, the female body of the female connector having a passageway configured to receive the projecting portion of the male body in the mated condition, the passageway extending into the female primary interface surface from the primary interface plane and in the first direction away from the primary interface plane;

wherein the projecting portion and the passageway are located on a first side of the primary interface plane in the mated condition of the connectors;

wherein the male body of the male connector has a recess extending about a portion of the male primary interface surface and a key extending about a remainder portion of the male primary interface surface, the recess and the key extending in a second direction away from the primary interface plane, the second direction being opposite of the first direction;

wherein the female body of the female connector has a flange configured to be received in the recess of the male body of the male connector in the mated condition, the flange defining a key slot configured to receive the key when the connectors are in the mated condition such that the flange and the key form a continuous perimeter when the connectors are in the mated condition, the flange and the key slot extending in the second direction away from the primary interface plane; and wherein the recess and the key of the male body and the flange and key slot of the female body are located on a second side of the primary interface plane in the mated condition of the connectors, the second side being located on an opposite side of the primary interface plane from the first side.

* * * * *